US008915720B2

(12) United States Patent
Parikah et al.

(10) Patent No.: US 8,915,720 B2
(45) Date of Patent: Dec. 23, 2014

(54) FAN HUB INTEGRATED VACUUM PUMP SYSTEM

(75) Inventors: Bhavin Parikah, Greenwood, IN (US); Kristopher R. Bare, Columbus, IN (US)

(73) Assignee: Cummins Inc., Columbus, IN (US)

( * ) Notice: Subject to any disclaimer, the term of this patent is extended or adjusted under 35 U.S.C. 154(b) by 1637 days.

(21) Appl. No.: 12/021,633

(22) Filed: Jan. 29, 2008

(65) Prior Publication Data

US 2009/0169400 A1 Jul. 2, 2009

Related U.S. Application Data

(60) Provisional application No. 61/009,784, filed on Dec. 31, 2007.

(51) Int. Cl.

| | |
|---|---|
| ***F04B 17/05*** | (2006.01) |
| ***F01C 17/06*** | (2006.01) |
| ***F04D 25/16*** | (2006.01) |
| ***F04C 23/00*** | (2006.01) |
| ***F04C 29/00*** | (2006.01) |
| ***F04D 29/32*** | (2006.01) |
| ***F04C 23/02*** | (2006.01) |
| *F04C 18/344* | (2006.01) |
| *F04C 25/02* | (2006.01) |

(52) U.S. Cl.

CPC ..... *F04D 29/329* (2013.01); *F04C 2220/10* (2013.01); *F04B 17/05* (2013.01); *F01C 17/06* (2013.01); *F04D 25/16* (2013.01); *F04C 23/005* (2013.01); *F04C 18/3442* (2013.01); *F04C 25/02* (2013.01); *F04C 29/0071* (2013.01); *F04C 29/0085* (2013.01); *F04C 23/02* (2013.01)

USPC ..... 417/362; 417/364

(58) Field of Classification Search

CPC ..... F04D 25/02

USPC ..... 417/362, 364; 416/200 R, 200 A; 123/198 C, 41.46; 303/12

See application file for complete search history.

(56) References Cited

U.S. PATENT DOCUMENTS

| | | | | | |
|---|---|---|---|---|---|
| 2,506,547 | A | * | 5/1950 | Findley | 123/41.46 |
| 2,740,388 | A | * | 4/1956 | Bennorth | 123/41.12 |
| 2,808,817 | A | * | 10/1957 | Graham et al. | 123/41.12 |
| 2,852,009 | A | * | 9/1958 | Turlay | 123/41.1 |
| 2,871,836 | A | * | 2/1959 | Doughty | 123/41.1 |
| 3,268,042 | A | * | 8/1966 | Sargeant et al. | 192/84.3 |
| 3,934,966 | A | * | 1/1976 | Asberg | 415/170.1 |
| 3,981,610 | A | * | 9/1976 | Ernst et al. | 415/124.2 |
| 4,212,270 | A | * | 7/1980 | Nakanishi et al. | 123/41.09 |

(Continued)

FOREIGN PATENT DOCUMENTS

| | | | |
|---|---|---|---|
| JP | 9-144678 | A | 6/1997 |
| JP | 09-144678 | A | 6/1997 |

(Continued)

OTHER PUBLICATIONS

WO 2006035552 A1 Translation, 2006.*

(Continued)

*Primary Examiner* — Charles Freay
*Assistant Examiner* — Christopher Bobish
(74) *Attorney, Agent, or Firm* — Faegre Baker Daniels LLP

(57) ABSTRACT

An integrated fan and pump drive system.

15 Claims, 5 Drawing Sheets

(56) References Cited

U.S. PATENT DOCUMENTS

| | | | | |
|---|---|---|---|---|
| 4,911,610 | A * | 3/1990 | Olschewski et al. | 415/170.1 |
| 5,026,253 | A * | 6/1991 | Borger | 415/229 |
| 5,076,216 | A * | 12/1991 | Ro | 123/41.46 |
| 5,224,823 | A * | 7/1993 | Cordts | 415/206 |
| 6,089,833 | A * | 7/2000 | Glanfield et al. | 417/362 |
| 7,597,070 | B2 * | 10/2009 | Krolewski et al. | 123/41.11 |
| 7,775,765 | B2 * | 8/2010 | Hoji | 415/168.1 |
| 2005/0100455 | A1 * | 5/2005 | Tuddenham | 417/410.3 |
| 2005/0196297 | A1 * | 9/2005 | Baumgartner et al. | 417/364 |

FOREIGN PATENT DOCUMENTS

| | | | | |
|---|---|---|---|---|
| KR | 10-1999-0011763 | A | 2/1999 | |
| KR | 1999-011763 | A | 2/1999 | |
| KR | 10-2005-0043375 | A | 5/2005 | |
| WO | 97/24530 | A1 | 7/1997 | |
| WO | WO 2006035552 | A1 * | 4/2006 | F04D 29/049 |

OTHER PUBLICATIONS

Notification Concerning Transmittal of International Preliminary Report on Patentability with the mailing date of Jul. 15, 2010; International Application No. PCT/US2008/087942.

Written Opinion of the International Searching Authority with the mailing date of Jul. 20, 2009; International Application No. PCT/US2008/087942.

Notification of the First Office Action from the State Intellectual Property Office of P.R.C. with mailing date of Oct. 19, 2011 from corresponding Chinese Patent Application No. 200880123569.X.

* cited by examiner

FAN HUB INTEGRATED VACUUM PUMP SYSTEM

The present application claims the benefit of U.S. Provisional Patent Application Ser. No. 61/009,784, titled FAN HUB INTEGRATED VACUUM PUMP SYSTEM, filed Dec. 31, 2007, the disclosure of which is incorporated herein by reference.

FIELD

The present disclosure generally relates to vacuum pumps, and more particularly to integrated vacuum pumps on engines.

BACKGROUND

Internal combustion engines generate emissions that are undesirable for a variety of reasons. It is well known that waste products in engine exhaust such as carbon monoxide, hydrocarbons, and nitrogen oxides adversely affect human health, and present risks to the environment. Diesel engines in particular produce considerable amounts of soot, which contains particulate matter, black carbon, sulfur dioxide, nitrogen oxides and other hazardous pollutants. Several government agencies regulate emissions of such material.

Various sub-systems are necessary for engine operation. Such sub-systems induce loads upon the engine and thereby decrease efficiency. A decrease in efficiency results in increased exhaust for an equal useful output. Decreasing of loads seen by an engine allow increased efficiency, decreased fuel use, and decreased emissions. Elimination or consolidation of sub-systems may also present the ability have the engine be more compact with an equivalent power output.

The above mentioned and other features of this disclosure, and the manner of attaining them, will become more apparent and the disclosure itself will be better understood by reference to the following description of embodiments of the disclosure taken in conjunction with the accompanying drawings.

DETAILED DESCRIPTION

The embodiments disclosed below are not intended to be exhaustive or to limit the disclosure to the precise forms disclosed in the following detailed description. Rather, the embodiments are chosen and described so that others skilled in the art may utilize their teachings.

On vehicles with power brakes, a brake pedal pushes a rod that passes through a booster into a master cylinder, actuating a master-cylinder piston. A partial vacuum is created inside the vacuum booster on both sides of a diaphragm. When the brake pedal is pressed, the rod cracks open a valve, allowing air to enter the booster on one side of the diaphragm while sealing off the vacuum. This increases pressure on that side of the diaphragm so that it helps to push the rod, which in turn pushes the piston in the master cylinder. A vacuum source 100 is provided to produce the vacuum surrounding the diaphragm. While vacuum pump 100 is discussed herein as supplying a braking system, the concepts are applicable to other pump applications.

Figure 1:
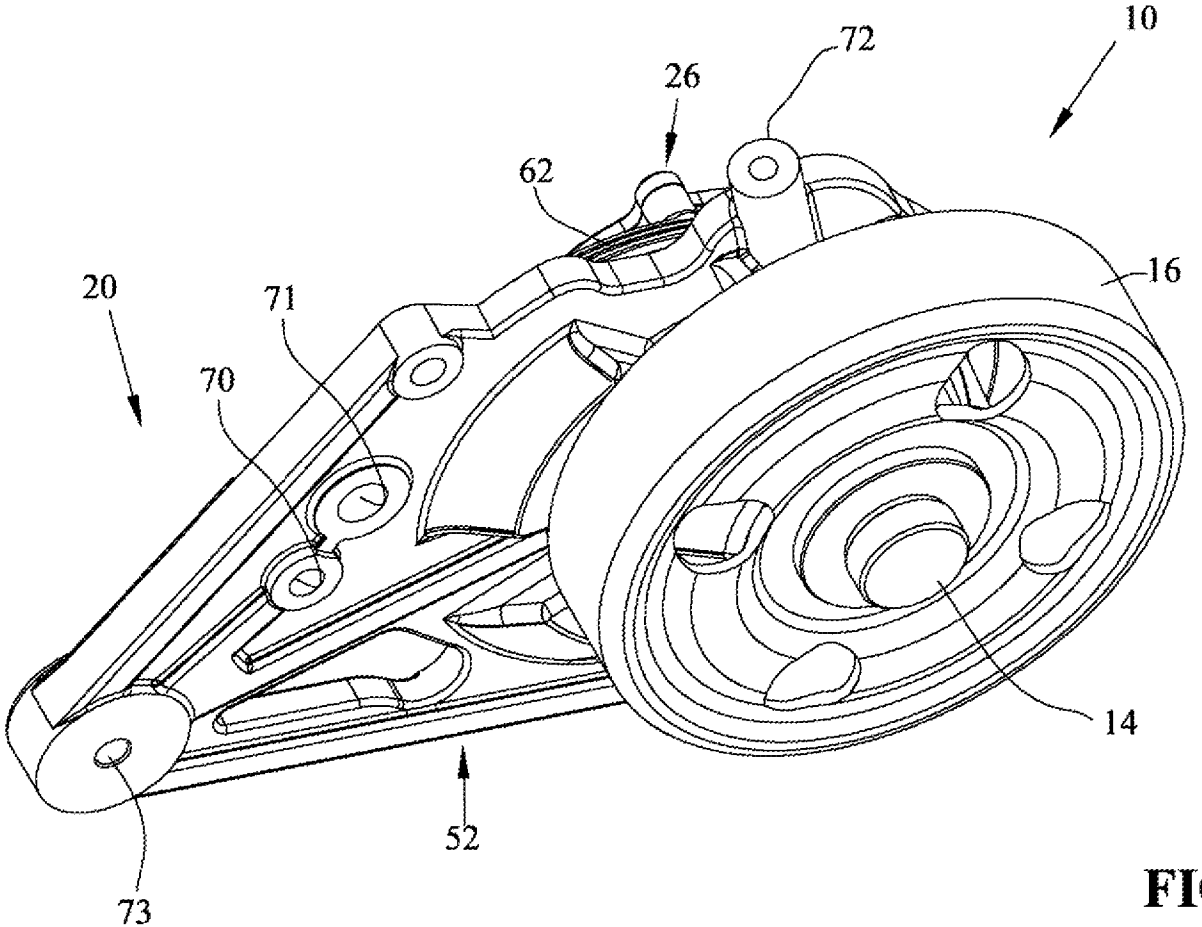
FIG. 1 is a front perspective view of a vacuum pump integrated with a fan hub pulley and a body.
Figure 2:
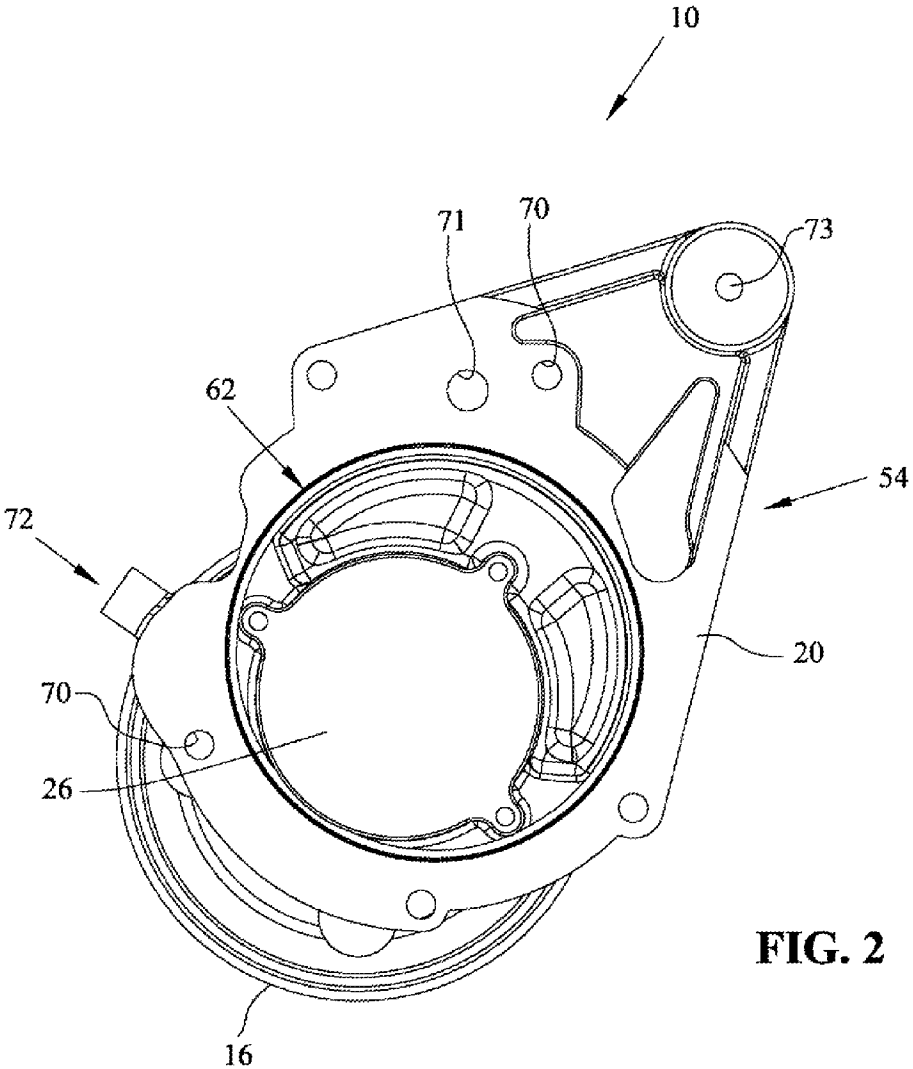
FIG. 2 is back view of the integrated system of FIG. 1.
Figure 3:
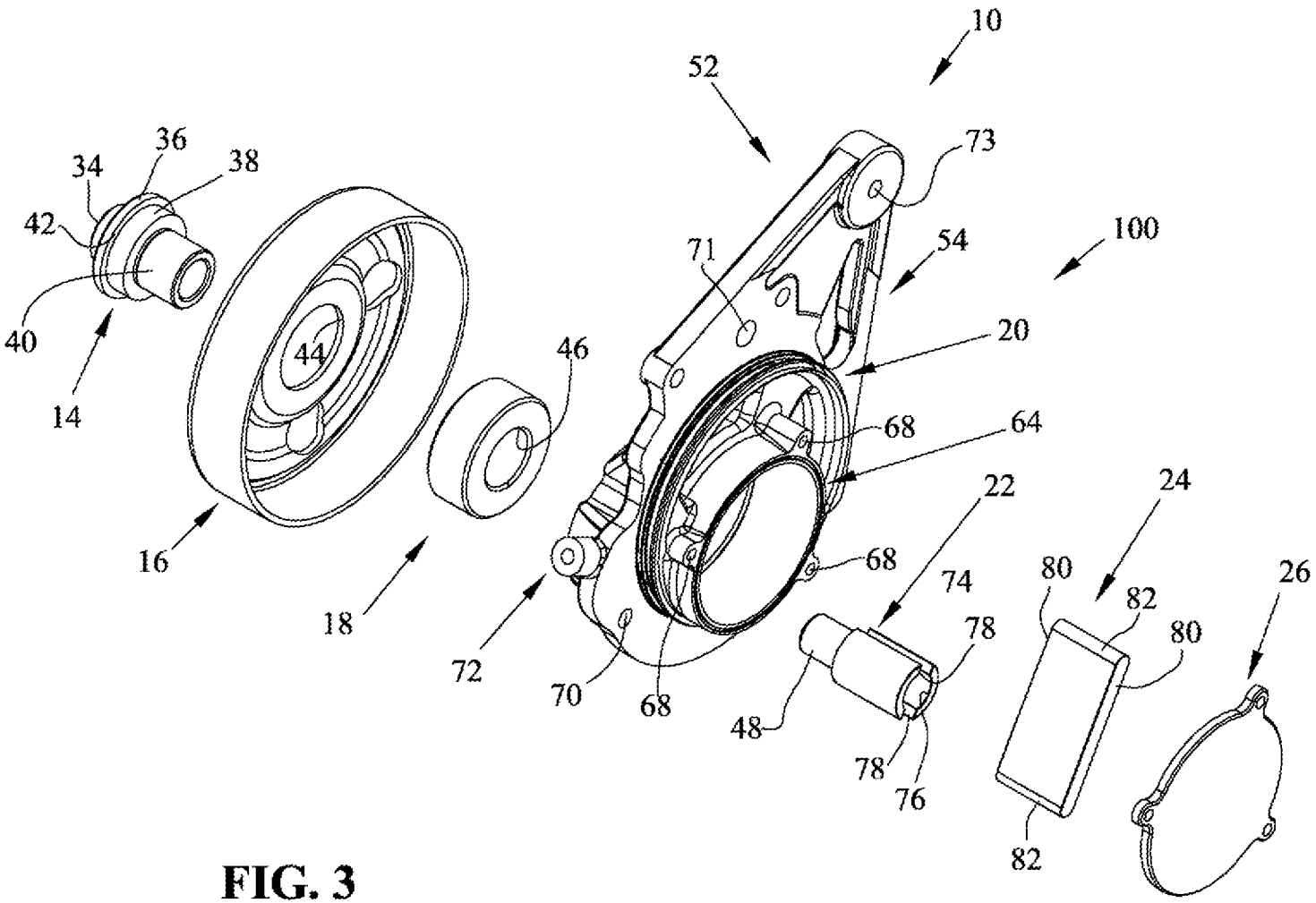
FIG. 3 is an exploded view of the integrated system of FIG. 1.
Figure 4:
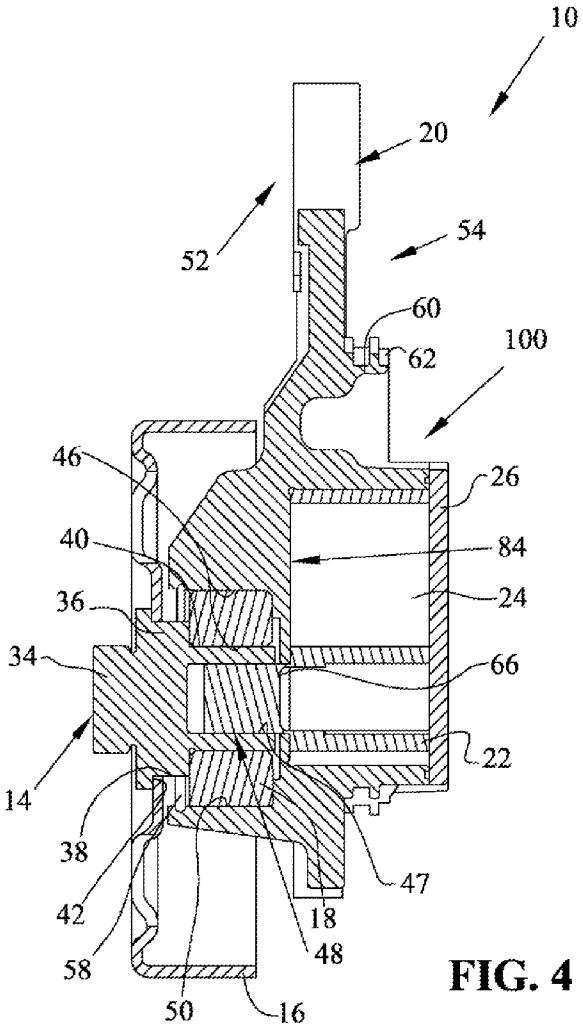
FIG. 4 is a cross sectional view of the integrated system of FIG. 1.

FIG. 1 shows an integrated vacuum pump and fan pulley, referred to herein as "integrated system" 10. Integrated system 10 is configured to be mounted on a front of engine 12. Integrated system 10 includes fan hub 14, pulley 16, bearing 18, body 20, rotor 22, vane 24, back plate 26, and various sealing members disposed between these parts.

Front of engine 12 includes front cover bore 28, mounting points 30, and oil feed duct 32. Front cover bore 28 serves as a fuel pump access bore, a valley access bore, a vacuum pump discharge, and a sealing surface. Front cover bore 28 is substantially circular and sized to receive a portion of body 20 therein. Mounting points 30 align with similar points on body 20 and receive fasteners, such as bolts, not shown, to couple body 20 thereto. Oil feed duct 32 is located to supply oil to system 10.

Fan hub 14 includes multiple sections of differing diameters. The multiple sections include clutch interface section 34, pulley retainer section 36, pulley receiving section 38, and bearing section 40. Clutch interface section 34 interfaces with a fan clutch (not shown). Pulley retainer section 36 and pulley receiving section 38 form shoulder 42 at the common boundary thereof. Pulley retainer section 36 is sized to be larger than hub bore 44 of pulley 16. Pulley receiving section 38 is of a diameter substantially equal to hub bore 44 and is sized to be received therein. Bearing section 40 is sized to have an outer diameter substantially equal to inner bore 46 of bearing 18. Bearing section 40 also has bore 47 defined therein that is sized to receive drive section 48 of rotor 22 therein.

Pulley 16, as shown, is a six-rib pulley. However, any other pulley suitable for being belt driven may be used. Pulley 16 includes hub bore 44 sized to receive pulley retainer section 36 of fan hub 14 therein.

Bearing 18 is an annular bearing having an outer diameter substantially equal to the diameter of pump drive bore 50 of body 20. Inner bore 46 of bearing 18 has a diameter substantially equal to the outer diameter of bearing section 40 of fan hub 14. It should be appreciated that while bearing 18 is described as providing an interface surface, other parts such as bushings, journal bearings, roller and ball bearings, split bearing arrangements, and combinations thereof, either wet or dry, are also envisioned.

Body 20 partially provides a front cover for engine 12. Body 20 further includes front side 52 that, when attached to engine 12, faces in a forward direction. Body 20 also includes rear side 54 that, when attached faces in a rearward direction and is partially abutted to engine 12. Front side 52 includes pump drive bore 50 defined therein that is sized to receive bearing 18 therein. Pump drive bore 50 is of a depth to fully receive bearing 18 and a bearing sealing member 58 therein. Rear side 54 of body 20 includes a front cover sealing surface 60 that is substantially circular and sized to seal, via seal 62, to the front cover of engine 12. It should be appreciated that while sealing surface 60 is shown and described as being circular, perimeters of other shapes are also envisioned. Rear side 54 of body 20 also includes pump chamber 64 defined therein. Pump chamber 64 houses rotor 22 and vane 24. Pump chamber 64 includes rotor bore 66 that extends from pump chamber 64 to pump drive bore 50. Rotor bore 66 is within and eccentric relative to pump chamber 64.

Body 20 also includes three plate coupling bores 68, a plurality of engine attachment bores 70, engine lifting stud hole 71, air inlet 72, idler pulley support 73, and a lubrication duct (not shown). Plate coupling bores 68 are located externally around the periphery of pump chamber 64. Engine attachment bores 70 are sized to receive fasteners therethrough and are located to align with similar bores in engine 12. Air inlet 72 allows for air to be pulled into pump chamber 64. The lubrication duct allows a lubricant to be supplied to pump chamber 64 and the moving parts therein.

Rotor 22 is substantially cylindrical and includes drive section 48 and vane section 74. Drive section 48 has a diameter sized to extend through rotor bore 66 and be press fit within bore 47 of fan hub 14. Vane section 74 has a larger diameter than drive section 48 and includes inner bore 76 and two longitudinal openings 78. Longitudinal openings 78 are located 180 degrees opposite of each other such that they combine to provide a vane path therein. While a single vane rotor is shown, rotors for multiple vane pumps are also envisioned.

Vane 24 is a flat piece constructed from plastic. Vane 24 has substantially flat lateral edges 80 and rounded longitudinal edges 82. Vane 24 is of a length that is less than the diameter of pump chamber 64. Vane 24 is of a thickness slightly less than the width of longitudinal openings 78. Longitudinal edges 82 are shaped to achieve a desired efficiency and performance.

Back plate 26 includes a pump output (not shown) that discharges an oil and air mixture from system 10. The pump output is coupled to reed valve to substantially prevent backflow into vacuum pumps 100. This prevents the output mixture from re-entering pump chamber 64. The reed valve further assists in maintaining vacuum in pump chamber 64.

In assembly, bearing 18 is seated within pump drive bore 50 such that inner bore 46 of bearing 18 is concentrically aligned with rotor bore 66 of body 20. Pulley 16 receives and is secured to fan hub 14 and is seated against shoulder 42. The connection of pulley 16 to fan hub 14 prevents relative rotation therebetween. The pulley 16 and fan hub 14 combination is then inserted into body 20 such that bearing section 40 of fan hub 14 is within inner bore 46 of bearing 18. Rotor 22 is then inserted from rear side 54 of body 20 into pump chamber 64 such that drive section 48 of rotor 22 is secured within bore 47 of bearing section 40 of fan hub 14. Fan hub 14, pulley 16, and rotor 22 are all coaxial in that they share a common axis of rotation. The connection of rotor 22 to fan hub 14 prevents relative rotation therebetween. Accordingly, a rotation of pulley 16 is translated into a rotation of rotor 22. Vane 24 is placed within longitudinal openings 78 of rotor 22 within pump chamber 64 such that a lateral edge of vane 24 contacts base wall 84 of pump chamber 64. Back plate 26 is then coupled to body 20 via fasteners and plate coupling bores 68. Once so assembled, integrated system 10 is coupled to engine 12 via fasteners and mounting points 30. It should be appreciated that seals are present between many of the coupled parts. Such seals are not described herein in that one skilled in the art is familiar with where such seals are necessary.

Once integrated system 10 is coupled to engine 12, oil feed duct 32 of the front wall of engine 12 is aligned with and in fluid communication with lubrication duct(s) (not shown) in body 20. Alternatively, lubrication duct(s) and oil feed duct 32 of engine 12 may be external from the wall of engine 12. Although not explicitly shown, lubrication duct of body 20 interfaces with pump chamber 64 generally in the area designated by the "A" in FIG. 5. It should be appreciated that the lubrication duct may be located in areas other than that designated by the "A." Similarly, air inlet 72 of body 20 interfaces with pump chamber 64 generally in the area designated by the "A" in FIG. 5.

Figure 5:
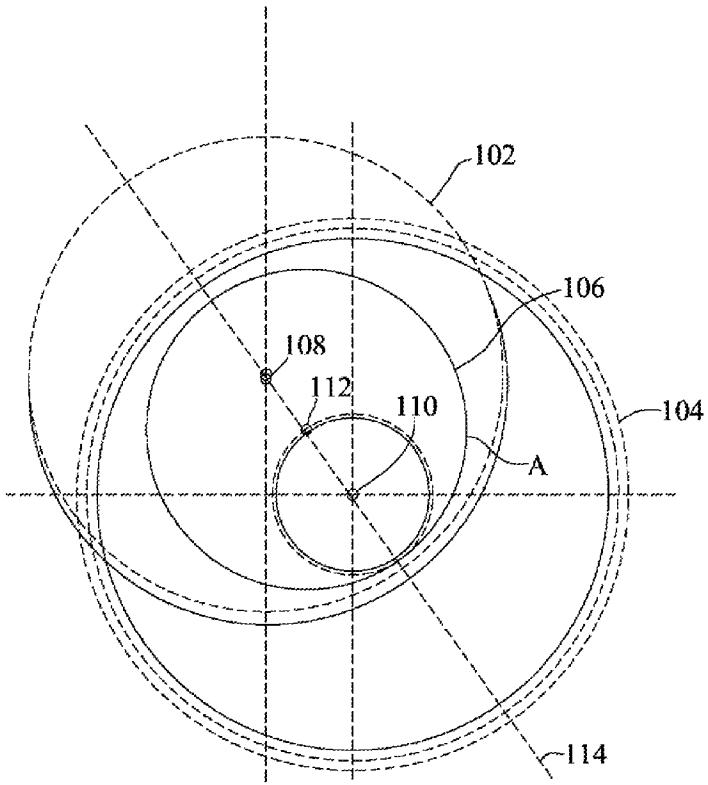
FIG. 5 is an axial diagrammatic view of the assembled integrated system of FIG. 1 and engine showing a packaging envelope.
Figure 6:
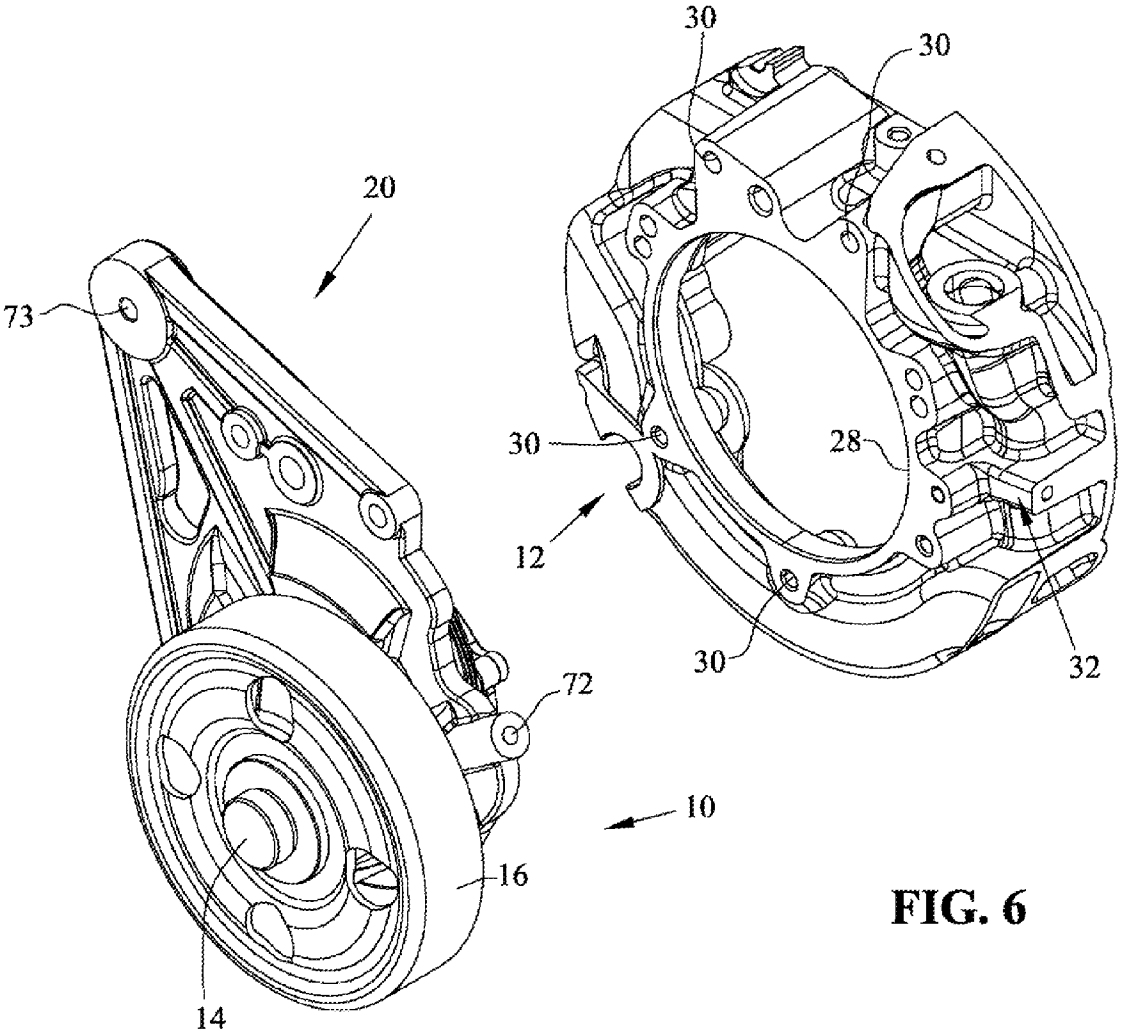
FIG. 6 is a partially exploded view showing the alignment of the integrated system of FIG. 1 and a front cover cutout of the engine.

As shown in FIG. 5, front cover bore 28 is substantially circular, although it could be non-circular, and defines perimeter 102. Pulley 16 and pump chamber 64 likewise define perimeters 104, 106, respectively. FIG. 5 is an axial diagrammatic view that shows the vertical and horizontal overlap of front cover bore 28, pump chamber 64, and pulley 16 via their perimeters 102, 104, 106. FIG. 5 looks along a plane perpendicular to the plane in which pulley 16 spins and along the axis of rotation of pulley 16. The perimeters 102 and 104 of front cover bore 28 and pulley 16 overlap. The perimeter 106 of pump chamber 64 is located fully within the overlapping section of the perimeters 102 and 104 of front cover bore 28 and pulley 16. Furthermore, the perimeter 106 of pump chamber 64 is substantially inscribed within the overlapping portion. In other words, the perimeter 106 of the pump chamber 64 is substantially the largest possible circle that could fit in the overlapping portion when taking the necessary wall thickness of the pump chamber 64 into account. Furthermore, each of the perimeters 102, 104, 106 define respective center points 108, 110, 112. Each of the center points is substantially collinear, as shown along line 114.

In operation, a crankshaft is rotated and that rotation is transmitted to pulley 16 via a belt (not shown). Accordingly, pulley 16 is a driven pulley as opposed to being a drive pulley or an idler pulley. The belt turns pulley 16 which likewise turns fan hub 14 and rotor 22. Rotor 22 and vane 24 thereby operate as a single vane pump 100. Accordingly, single pulley 16 translates movement from the belt to both fan hub 14 and vacuum pump 100. It should be further understood that while rotor 22 is shown as being integrated with the driven fan pulley, rotor 22 could be integrated with any front end accessory drive pulley or similar chain driven components such as a water pump, oil pump, fuel pump, alternator, power steering pump and air compressor.

Furthermore, rotation of the fan is in a one-to-one relationship with the rotation of rotor 22 of vane pump 100. Other embodiments of vane pumps are driven by a separate pulley that is smaller, or larger, than the fan pulley. Accordingly, such vane pumps rotate at an increased, or decreased, rate relative to the fan. Given a common engine RPM, rotor 22 of vane pump 100 rotates at a decreased rate relative to a pump being powered by a smaller pulley. The decreased rate of rotation allows the pump output to be partially regulated by a reed valve. The reed valve is an un-powered valve and reduces back flow of air/oil into pump 100. Back flow of the oil/air mixture into pump 100 causes inefficiencies and thus greater load. Lower speed rotation causes lower internal friction and thus lower parasitic loads. Accordingly, the reed valve requires less energy and provides less parasitic load when compared to powered valves sometimes necessary for pumps that operate at greater RPM.

While not pictured, a bypass pathway may also be installed at air inlet 72. The bypass pathway allows actuation of a compressor bypass valve in a turbocharger. In such embodiments air inlet 72 is coupled to both the compressor bypass valve and the brake booster.

Accordingly, body 20 and generally integrated system 10 provides many functions, it: 1) provides a vacuum that can be used to assist power braking or otherwise; 2) drives a fan through a clutch engagement; 3) provides a surface for a belt to support the front end accessory drive; 4) seals the front of engine 12; 5) supports an idler pulley; 6) sits on an engine stud; and 7) provides simultaneous powering of a compressor bypass valve and a brake booster.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

The invention claimed is:

1. An integrated fan hub and pump system including;

a pump body having a pump chamber therein, the pump chamber having a first perimeter;

a pulley having a second perimeter and an axis of rotation; and an engine housing having a front cover bore therein; the front cover bore sized and positioned to receive the pump chamber therein, the front cover bore having a third perimeter;

the second perimeter of the pulley and the third perimeter of the front cover bore partially overlapping when viewed along the axis of rotation to define an overlap portion that both the second and third perimeters have in common and a non-overlapping portion where the second perimeter of the pulley extends beyond the third perimeter of the front cover bore;

the third perimeter of the front cover bore having a third perimeter center point positioned a spaced transverse distance from the axis of rotation.

2. The system of claim 1, wherein the first perimeter is located within the overlap portion.

3. The system of claim 2, wherein the first perimeter is substantially inscribed within the overlap portion.

4. The system of claim 1, wherein the first perimeter is substantially circular.

5. The system of claim 1, wherein the second and third perimeters are substantially circular, the first and second perimeters defining first and second perimeter center points, respectively, the first, second, and third perimeter center points each being positioned a spaced transverse distance from one another when viewed in a plane perpendicular to the axis of rotation.

6. The system of claim 1, further including a rotor disposed in the pump chamber, the rotor having an axis of rotation in common with the pulley.

7. The system of claim 5, wherein said first, second, and third perimeter center points are substantially collinear when viewed in a plane perpendicular to the axis of rotation.

8. The system of claim 6, further comprising a vane coupled to the rotor.

9. The system of claim 6, further comprising a fan hub coupled to the rotor, wherein rotation of the pulley about the axis of rotation rotates both the rotor and the fan hub.

10. The system of claim 1, further comprising an air inlet in communication with the pump chamber.

11. The system of claim 1, wherein the second perimeter of the pulley and the third perimeter of the front cover bore further define another non-overlapping portion where the third perimeter of the front cover bore extends beyond the second perimeter of the pulley.

12. The system of claim 1, wherein the pump chamber has a front wall and a back plate, each of the front wall and back plate are distinct from the engine housing.

13. The system of claim 12, wherein the front wall and back plate define interior pump chamber walls that are parallel with each other.

14. The system of claim 12, wherein the pump chamber is defined by the front wall, the back plate, and a cylindrical wall that defines the first perimeter.

15. The system of claim 1, wherein, when assembled, a plane that is perpendicular to the axis of rotation intersects both the pump chamber and the engine housing.

* * * * *